US006217271B1

(12) United States Patent
Latvakangas et al.

(10) Patent No.: US 6,217,271 B1
(45) **Date of Patent: *Apr. 17, 2001**

(54) METHOD FOR MANUFACTURING BOOKLETS AND A DEVICE THEREFOR

(75) Inventors: Urpo Latvakangas, Saltsjö-Boo; Jan Sabelström, Huddinge, both of (SE)

(73) Assignee: Bindomatic AB, Stockholm (SE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/142,823

(22) PCT Filed: Mar. 11, 1997

(86) PCT No.: PCT/SE97/00412

§ 371 Date: Mar. 29, 1999

§ 102(e) Date: Mar. 29, 1999

(87) PCT Pub. No.: WO97/33761

PCT Pub. Date: Sep. 18, 1997

(30) Foreign Application Priority Data

Mar. 14, 1996 (SE) ..... 9600976

(51) Int. Cl.[7] ..... B42C 1/100; B65H 1/00

(52) U.S. Cl. ..... 412/4; 412/6; 412/8; 412/19; 412/20; 412/28; 412/900; 270/52.18; 270/58.08

(58) Field of Search ..... 412/4, 6, 8, 19, 412/20, 28, 900; 270/52.18, 58.08

(56) References Cited

U.S. PATENT DOCUMENTS 5,570,985 * 11/1996 Latvakangas et al. ..... 412/19
5,931,624 * 8/1999 Naruse ..... 412/4

* cited by examiner

*Primary Examiner*—A. L. Wellington
*Assistant Examiner*—Mark T Henderson
(74) *Attorney, Agent, or Firm*—Cooper & Dunham LLP

(57) ABSTRACT

The invention relates to a method and to a device for producing booklets, each of which comprises a cover (A) that has two cover sides, a spine between the cover sides, a glue string applied to the inner surface of the spine, and a sheet bundle inserted between the two cover sides. A plurality of covers each having an applied glue string are placed in the immediate vicinity of each other, in a readiness position. The sheet bundle (B) is then combined with one of the covers (A), so as to enclose the sheet bundle in the cover with one side edge of the bundle facing towards the glue string. The glue string is then actuated in an actuator (8), so as to bind this side edge of the bundle (B) to the inner surface of the spine. According to the invention, the sheet bundle (B) is combined with the cover (A) by moving the sheets of the bundle one by one, or as a complete bundle, to the cover in its readiness position by means of a powered transporter.

16 Claims, 4 Drawing Sheets

METHOD FOR MANUFACTURING BOOKLETS AND A DEVICE THEREFOR

FIELD OF INVENTION

The present invention relates to a method and to a device for manufacturing booklets of the kind defined in the respective preambles of Claim 1 and Claim 13. The booklets to be produced thus comprise a cover having two cover sheets and a spine therebetween, a glue string applied to the inner surface of the spine and a bundle of sheets enclosed between the two cover sheets with one edge of the sheet bundle affixed to the inner surface of the spine by means of the glue string.

DESCRIPTION OF THE BACKGROUND ART

Booklets of the aforedescribed kind are normally produced in the following way.

A flat sheet of board and/or plastic material is folded to provide a cover that is divided into two cover sheets and a spine. A string of hot melt glue is applied to the inner surface of the spine. The cover sides are then folded in towards one another to form a cover with the glue string located between the sheets. The finished covers are then packed and delivered to the user, who takes a cover from the package and inserts a bundle of sheets between the cover sheets so that one side edge of the bundle is in abutment with the glue string. The user then places the cover and enclosed sheets in a binding apparatus, e.g. of the kind described in SE-B-434 367, in which the outer surface of the spine is brought into contact with a hot plate. The glue melts within a given space of time and the bundle of sheets sinks down into the molten glue. The user then removes the cover and sheet bundle from the binding apparatus and allows the glue to cool, so as to firmly affix the edges of the sheets in said bundle to the spine.

The aforedescribed method is both complicated and time-consuming, particularly when a large number of booklets of one and the same kind or of different kinds shall be produced.

U.S. Pat. No. 5,102,277 teaches a method and a machine for binding bundles or sets of sheets in covers of the aforedescribed kind. Although the method and the machine described are developments of the manual binding of sheets achieved with binding apparatuses according to SE-B-434 367, the method and machine do not enable bundles of sheets, e.g. dispensed from a copier, to be combined with the bundle of empty covers inserted into the machine.

U.S. Pat. No. 2,549,890 teaches a book-fabricating machine. Book blocks are provided with glue on their respective side surfaces and introduced into covers that fall down singly from a magazine in the machine. The machine thus produces products of a kind other than booklets, wherein each product consists of a cover that is affixed to a sheet bundle solely at the spine of the cover. Moreover, the machine does not include means for activating a glue string so as to affix the bundle of sheets to the spine of the cover.

GB-A-1,258,746 teaches a book-binding machine for producing book blocks by applying a melt glue along one edge of the book block. The machine thus produces products of a kind other than booklets which comprise bundles of sheets affixed to the spines of the booklets. Moreover, this machine does not include sheet-bundle and booklet transporting means.

U.S. Pat. No. 3,093,396 teaches a book-binding machine in which paper sheets are joined together along one side edge thereof by means of several adhesive layers, such as to form a book block. Each book block is then combined with a cover that lacks a binding agent, whereafter to adhesive layers on the book block are activated via the cover spine, to join the block to the spine. The machine thus produces products of a kind other than booklets that consist of covers having spine-applied glue strings that are interconnected with bundles of sheets that are loose relative to one another prior to binding. Moreover, the covers are not collected in any form of cassette or the like from which they are transported to book blocks in the known machine.

Finally, WO94/26535 teaches a method and a device corresponding to the method and device defined in the preambles of respective Claims 1 and 13. This method and device enable the manual work to be reduced, the production rate to be increased and the quality of the finished booklets to be improved in comparison with earlier known techniques.

The method and the device are, however, relatively complicated. This is due primarily to the provision of a separate station for the actual combining step. This step requires transport means for moving the sheet bundle and for moving a cover to the combining station. Furthermore, it is necessary that the sheet bundle and the cover are moved to the position in which they are to be combined with satisfactory precision, both with respect to time and position.

SUMMARY OF THE INVENTION

Against this background, the object of the present invention is to provide a method and a device which, while retaining a high degree of automation, a high production rate and a finished booklet of good quality, is more simple and more reliable in operation than similar methods and devices known in the art.

This object has been achieved in accordance with the invention with a method of the kind defined in the preamble of Claim 1 and having the special features set forth in the characterizing clause of said Claim, and with a device of the kind defined in the preamble of Claim 1 and having the special features set forth in the characterizing clause of said Claim.

The feature of moving the sheet bundle to and combining said bundle with a cover that remains in position in the immediate vicinity of the remaining covers obviates the need of separate transport means for moving the cover to a separate combining station. This results in a device that is less complicated than the known devices with respect to automation, and therewith in cheaper production. The reduction in the number of components in the device also simplifies the method, which therewith becomes less sensitive to disturbances.

In one preferred embodiment of the invention, the covers are mutually stacked in a V-configuration in the readiness position. This facilitates insertion of a sheet bundle into one of these covers.

The V-configuration will preferably have an acute angle, preferably an angle smaller than 30°.

The covers are disposed beneficially with the spines facing downwards, so that the force of gravity will facilitate insertion of the sheet bundles.

These and other advantageous embodiments of the invention are defined in the accompanying dependent Claims.

The invention will now be described in more detail with reference to preferred embodiments thereof and also with reference to the accompanying drawings.

FIGS. 3*a–f* are respective side views of the combining step according to a third embodiment of the invention.

Figure 3:
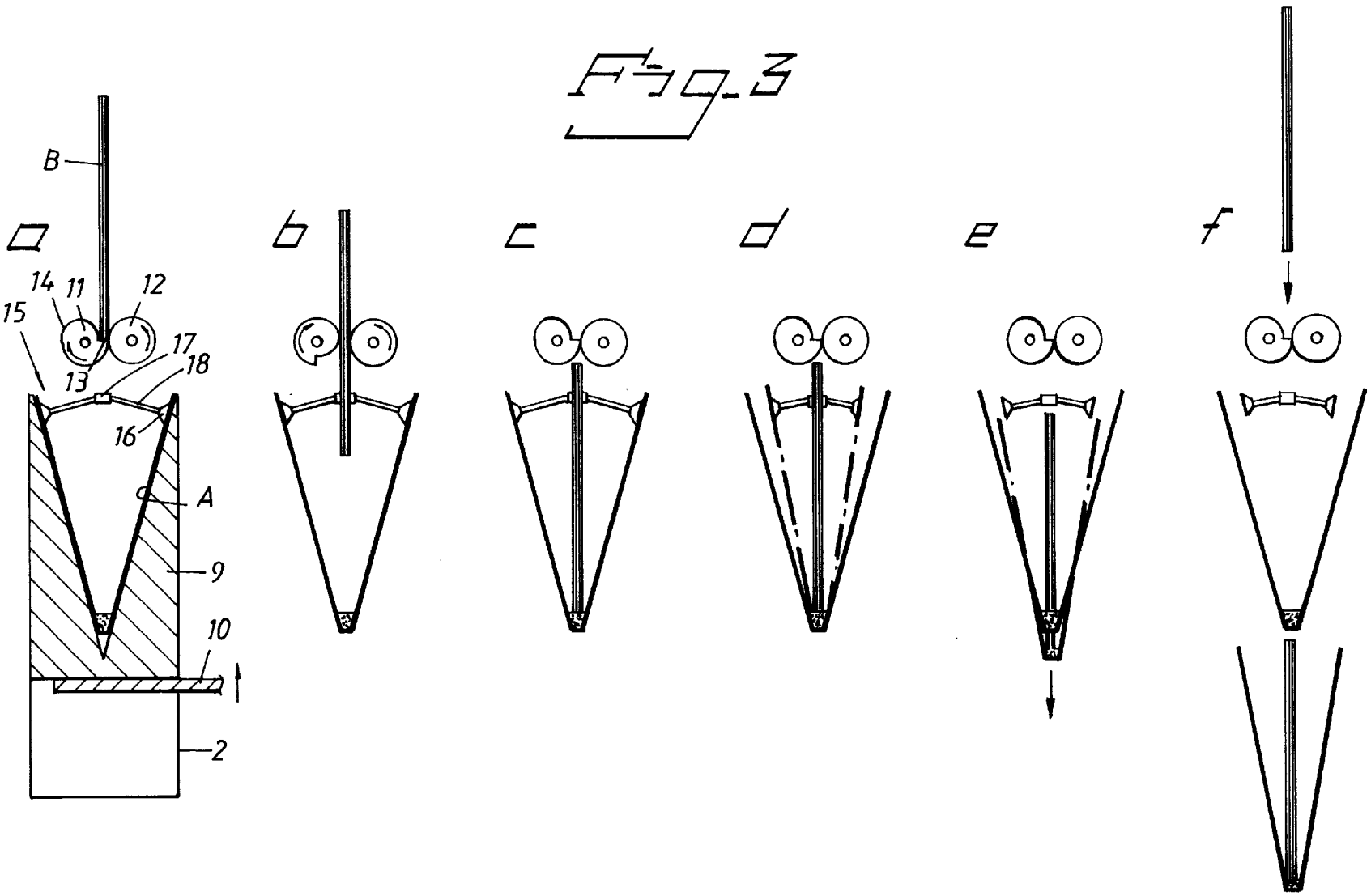

FIGS. 4*a–f* illustrate the step shown in FIG. 3 from above.

Figure 5:
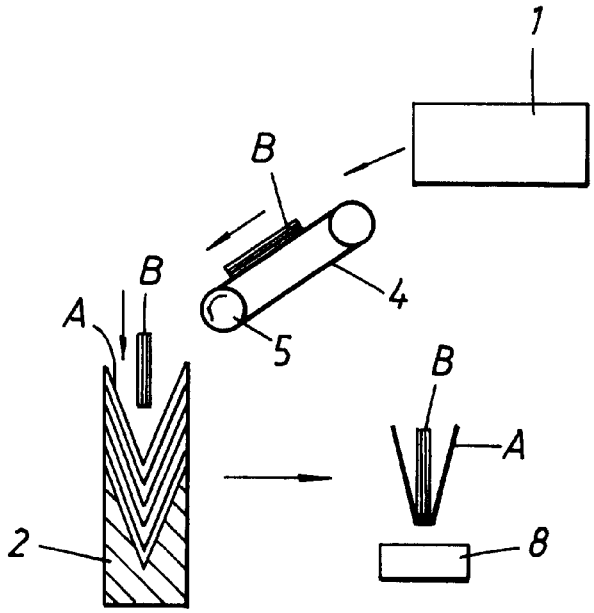

FIG. 5 is a schematic principle illustration of a third embodiment of the invention.

Figure 6:
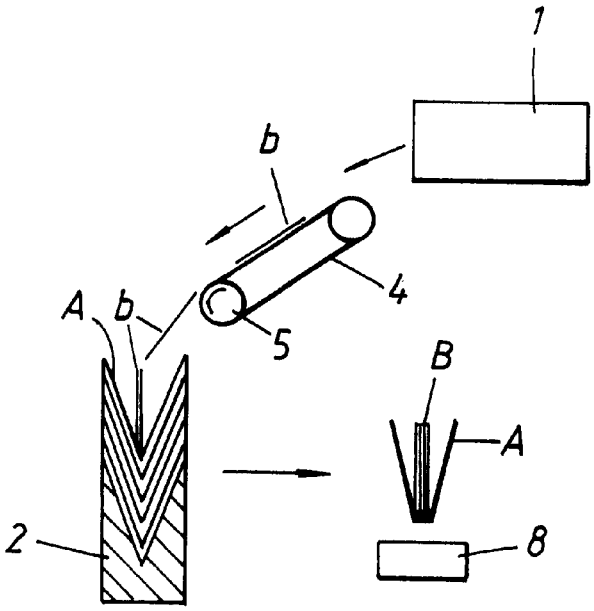

FIG. 6 is a schematic principle illustration of a fourth embodiment of the invention.

Figure 1:
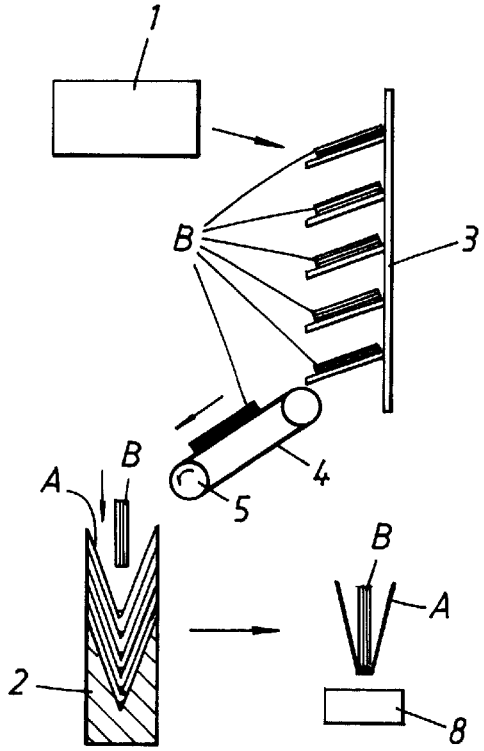
FIG. 1 is a schematic principle illustration of a first embodiment of the invention.

FIG. 1 illustrates schematically the various steps, or stages, carried out in a booklet fabricating process. The sheet bundles B are delivered from a unit 1 and passed to a magazine 2 that contains the covers A with which the sheet bundles B shall be affixed to form the booklet. Each cover A comprises two cover sides and a spine located therebetween, said spine having a glue string applied thereto.

Figure 2:
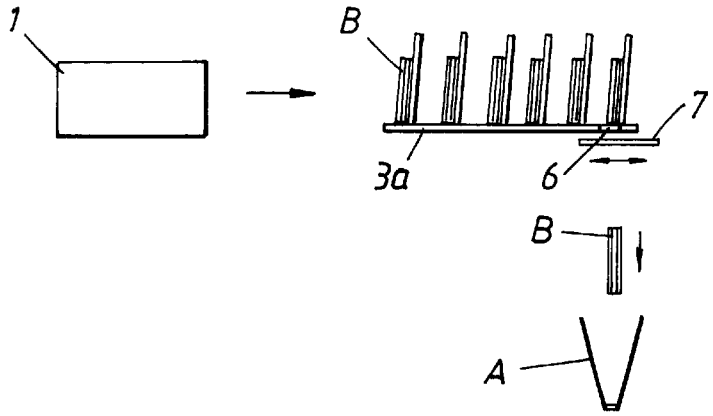
FIG. 2 is a schematic principle illustration of a second embodiment of the invention.

The unit 1 may be an office machine, such as a copier, a laser printer or some like machine. In principle, the sheet bundles B can be transported directly to the magazine 2 containing the covers A. In practice, however, the sheet bundles B are delivered to a collecting unit 3 in which a plurality of sheet bundles B are collected. A sheet bundle B is transported to the magazine 2 containing the covers A by means of a belt symbolized by the belt 4 in the arrowed direction. The transporter 4 is powered by the drive pulley 5. Alternatively, the sheet bundles B may be moved to the magazine 2 containing the covers A by the force of gravity. In this case, the transporter may comprise a slide path that guides the sheet bundles B down into one of the covers A, wherein a latching device releases that sheet bundle B which is in turn for transportation. As illustrated schematically in FIG. 2, a direct vertical combining movement is feasible, where the sheet bundles are received in the collecting unit 3*a* having a slight inclination from the vertical plane, and released down into the cover A through a slot which is controlled to open at specific intervals with the aid of a reciprocatingly movable plate 7.

Turning back to FIG. 1, it will be seen that after combining a sheet bundle B with one of the covers A in the magazine, the cover and bundle are removed from the remaining covers in the magazine 2 and transported to an activator 8. The sheet bundles B lie with the edges of the sheets against the glue string on the inner surface of the cover spine. The glue string is actuated in the actuator 8, e.g. heated, so that the sheet bundle B will adhere to the cover spine and therewith form a finished booklet. The booklet is then allowed to cool, optionally by passing it through a cooler.

The covers A in the magazine 2 are folded into a V-shape in the illustrated embodiment, with the covers nesting one within the other. Although this affords many advantages, the covers may, in principle, lie fully flat in a bundle in the magazine, and a sheet bundle combined with the covers, whereafter the covers are folded around the sheet bundles. When the covers are disposed in a V-configuration, the V-shape will conveniently have an acute angle, preferably an angle smaller than 30°. In this regard, the covers are folded appropriately along both joining lines between the spine and a respective cover side, so as to obtain a shape in the form of a "truncated V". It is advantageous for the V-shaped covers to open upwardly, thereby enabling the paper bundles to be dispensed gravitationally, and also to simplify removal of the cover. Naturally, other orientations are possible in which the opening of the V-shaped cover faces obliquely upwards, immediately to one side, or downwards. Neither is it necessary for the cover spine to lie in a horizontal plane.

Figure 4:
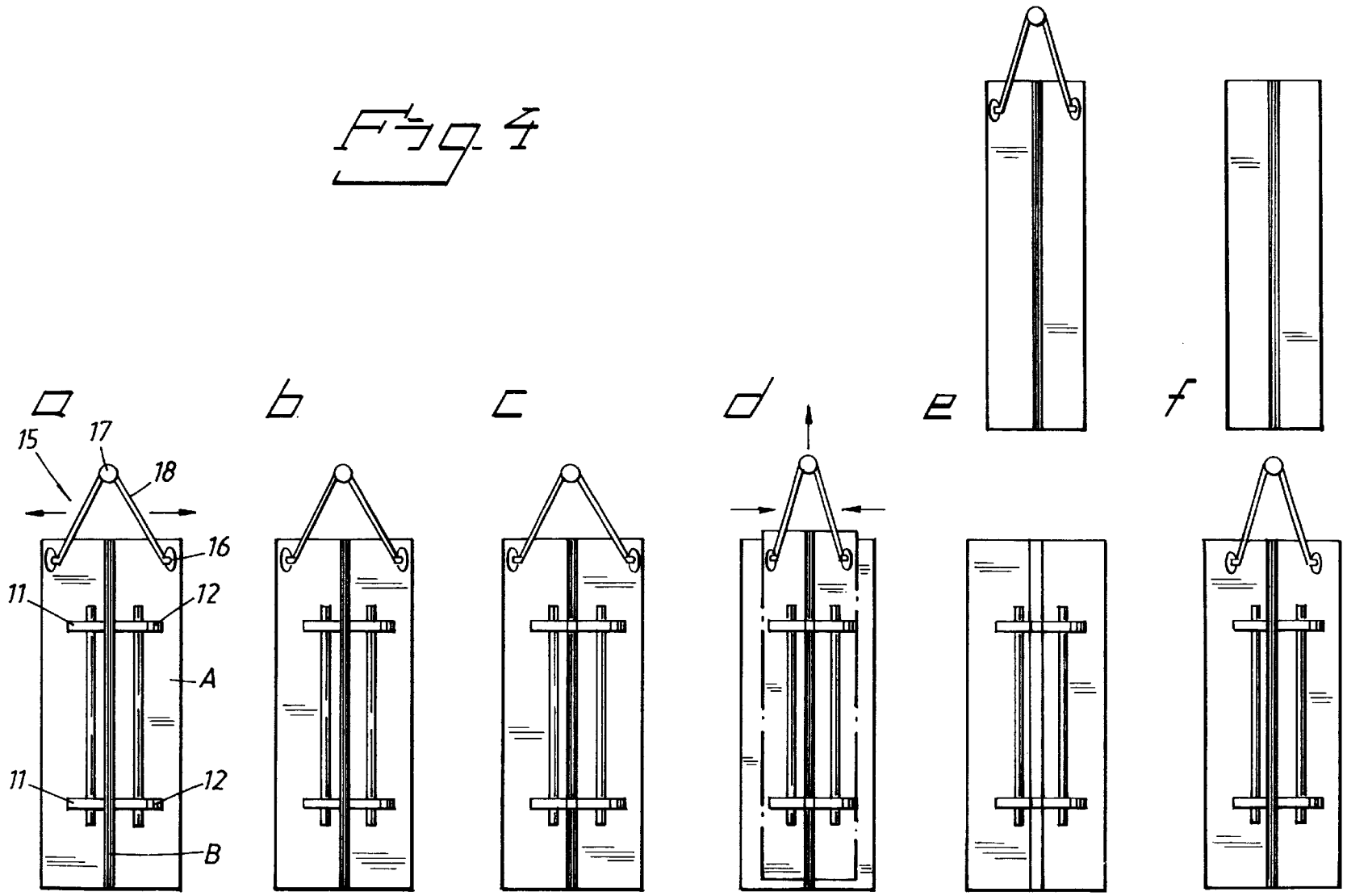

FIGS. 3 and 4 illustrate a preferred embodiment and show the manner in which a sheet bundle B is combined with a cover A and the manner in which the thus formed unit A+B is removed from the cover magazine. The part-FIGS. 3*a–f*, which show the procedure as seen from one side, are corresponded by the part-FIGS. 4*a–f* which show the procedure from above, wherein the same letters have been used in these part-Figures.

In the stage illustrated in FIGS. 3*a* and 4*a*, a sheet bundle B is in position for initiating combination of the bundle with one of the covers A in the magazine 2. The sheet bundle is introduced into the cover with the aid of two pairs of discs 11, 12 between which the sheet bundle B is advanced. One of the discs, the disc 11, has a camming surface 14 that includes a step 13 on which the sheet bundle B lies initially. The cover A is held open by a manoeuvering device 15 that comprises two legs, each of which is terminated with a suction cup 16 that lies against the inside of each cover side of the cover.

The discs 11, 12 rotate in the arrowed direction (FIG. 3*b*) so as to feed the sheet bundle downwards. FIG. 3*c* shows the sheet bundle B fully inserted in the cover A.

The legs 18 of the manoeuvering device 15 are pivotally connected to a central part 17 thereof. FIGS. 3*d* and 4*d* illustrate how the cover A containing sheet bundle B is withdrawn sideways from the magazine. The manoeuvering device 15 brings the legs 18 together such as to fold-in the cover A from the nearest adjacent cover. In this position of the manoeuvering device, the device is moved laterally outwards from the cover magazine (i.e. upwards in FIG. 4*e*), so as to move the cover completely free from the magazine. In this position, the cover A containing the sheet bundle B is released so as to fall under the force of gravity (see the arrow in FIG. 3*e*). FIG. 3*f* shows the cover after it has been released and is in position for actuation of the glue string. The next sheet bundle is on its way towards the transport discs 11, 12 and the manoeuvering device 15 has been moved into the cover bundle so as to firmly hold the next cover in line by suction.

As will be evident from FIG. 3*a*, the covers A are placed in a magazine 2 that includes a V-shaped support. The support can be lifted up by feed mechanism 10, so as to move the bundles and casings upwards as the covers are removed one after one, as described above.

In the case of the example illustrated in FIGS. 3 and 4, the sheet bundles are inserted centrally into the cover. The insertion direction may, alternatively, be asymmetrical in relation to the cover.

FIG. 5 illustrates an alternative embodiment of the invention in which the sheet bundles B are delivered directly from the office machine 1 via the belt 4. This embodiment thus differs from the FIG. 1 embodiment insomuch as the collecting unit is eliminated.

FIG. 6 illustrates a further embodiment in which the sheet bundle is formed in the cover A, by virtue of feeding the sheets b singly from the office machine 1 to the cover A via the transporter 4. When the number of sheets B that form a sheet bundle are fed one by one into the cover A, the steps illustrated in FIGS. 3 and 4 are carried out to remove the cover A containing sheet bundle B.

What is claimed is:

1. A method of fabricating booklets, each of which compromises a cover having two cover sides, a spine located therebetween, a glue string applied to an inner surface of the spine, and a sheet bundle that is inserted between the two cover sides and that has one side edge affixed to the inner surface of the spine by means of the glue string, comprising:

placing a plurality of covers with applied glue strings in an immediate proximity of each other in a readiness position, wherein the covers are disposed in a cassette in a state that is symmetrical in relation to a vertical plane through the cover spine;

transporting to the covers, one by one or as a complete bundle and by means of a powered transporter, sheets that are to form the sheet bundle;

moving said sheets, along a plane that is the symmetry plane of the cover through its spine, into contact with the cover fixed in said readiness position;

combining said sheet bundle with one of the covers such as to enclose the sheet bundle with said side edge of the bundle facing towards the glue string; and moving the cover containing said sheet bundle past an actuator that actuates the glue string so as to bind said bundle side edge to the inner surface of the spine.

2. A method according to claim 1, wherein each of the covers in said readiness position is folded along at least one joining line that joins the spine with a respective cover side, such as to form a generally V-shaped unit, said units being nested one within the other.

3. A method according to claim 1, wherein each of said covers is disposed in said readiness position with its spine facing downwards.

4. A method according to claim 1, wherein prior to the combining step, a cover is brought to a combining position and said plurality of covers are fed commonly in a direction towards said combining position.

5. A method according to claim 1, wherein the sheets in the sheet bundle are initially placed by feed means in an operational position from which said sheets can be moved by said powered transporter.

6. A method according to claim 1, wherein the sheets in the sheet bundle are dispensed from an office machine, such as a copier or laser printer, and moved from said office machine to said operational position.

7. A method according to claim 1, wherein the glue string is actuated by heating the glue string, so as to cause the glue string to melt at least partially, and wherein the glue string is then allowed to cool to a solid state.

8. A method according to claim 2, wherein each of the covers is folded to define an acute angle in said V-shape.

9. A method according to claim 8, wherein each cover is folded at an angle of less than 30° in said V-shape.

10. A device for fabricating booklets, each of which compromises a cover having two cover sides, a spine between said sides, a glue string applied to an inner surface of the spine, and a sheet bundle contained between the two cover sides, and one side-edge of each bundle is bound to the inner surface of the spine by means of the glue string, wherein the device comprises:

a cover magazine for a plurality of covers having applied glue strings, wherein the magazine is equipped with a detachable and refillable cassette to accommodate a plurality of covers in an immediate vicinity of one another, and includes support means that hold the covers in a readiness position with the spine facing downwards in a position that is symmetrical in relation to a vertical plane through the cover spines;

a combining device for combining the sheet bundle with one of the covers so as to enclose the sheet bundle in said cover with said side-edge of the bundle facing towards the glue string, the combining device including a powered transporter which functions to move sheets that are to form the sheet bundle one by one or as a complete bundle and along a plane that is the symmetry plane of the cover through its spine to said one cover fixed in said readiness position in said magazine; and a device for transporting a combined cover and sheet bundle from said cover magazine.

11. A device according to claim 10, wherein the cover magazine is adapted to accommodate said plurality of covers nested within one another with each cover folded along at least one joining line that joins said spine with a respective cover side into a generally V-shape.

12. A device according to claim 10, further comprising feed means for advancing said plurality of covers commonly in said cover magazine.

13. A device according to claim 10, further comprising a maneuvering device which is adapted to transport the cover with a sheet bundle to an activator for actuation of the glue string.

14. A device according to claim 11, wherein said cover magazine is dimensioned so that the V-shape will have an acute angle.

15. A device according to claim 14, wherein said angle is smaller than 30°.

16. A device according to claim 13, wherein the activator includes heating means.

* * * * *